US006012546A

United States Patent [19]

Bee et al.

[11] Patent Number: 6,012,546

[45] Date of Patent: Jan. 11, 2000

[54] SAFETY LADDER

[76] Inventors: Dana A. Bee; Tonya A. Bee, both of 1506 Division St. Ext., Parkersburg, W. Va. 26101

[21] Appl. No.: 09/036,435

[22] Filed: Mar. 5, 1998

[51] Int. Cl.[7] ..... E06C 7/48

[52] U.S. Cl. ..... 182/107; 182/109; 182/204; 182/106

[58] Field of Search ..... 182/107, 163, 182/214, 109, 106, 204; 294/137, 29; 16/114 R, 110 A, 124

[56] References Cited

U.S. PATENT DOCUMENTS

| | | | |
|---|---|---|---|
| 1,152,687 | 9/1915 | Acton | 182/109 |
| 2,691,479 | 10/1954 | Sharp | 182/109 |
| 2,767,898 | 10/1956 | Cramer | 182/109 |
| 3,071,204 | 1/1963 | Piltingsrud | 182/27 |
| 3,143,185 | 8/1964 | Wenger | 182/27 |
| 3,861,500 | 1/1975 | Dempsey | 182/204 |
| 4,146,114 | 3/1979 | Beavers | 182/106 |
| 4,694,932 | 9/1987 | Schmitt | 182/109 |
| 5,165,501 | 11/1992 | Donahey | 182/107 |
| 5,651,417 | 7/1997 | Coughlin | 182/109 |

FOREIGN PATENT DOCUMENTS

| | | | |
|---|---|---|---|
| 2160570 | 12/1985 | United Kingdom | 182/107 |

*Primary Examiner*—Alvin Chin-Shue

[57] ABSTRACT

A new Safety Ladder for providing a ladder which may be safely and stably positioned relative to a building. The inventive device includes a pair of side rails, a plurality of spaced rungs supported between the side rails, a pair of adjustable legs each telescopically extendable from a lower end of one of the side rails, and a pair of standoff arms each pivotally coupled to an upper end of one of the side rails. A first foot adapted for frictional engagement with an underlying surface is pivotally coupled to the free end of each of the adjustable legs and a second foot adapted for frictional engagement with a roof of a building is pivotally coupled to the free end of each of the standoff arms.

9 Claims, 3 Drawing Sheets

FIG. 5
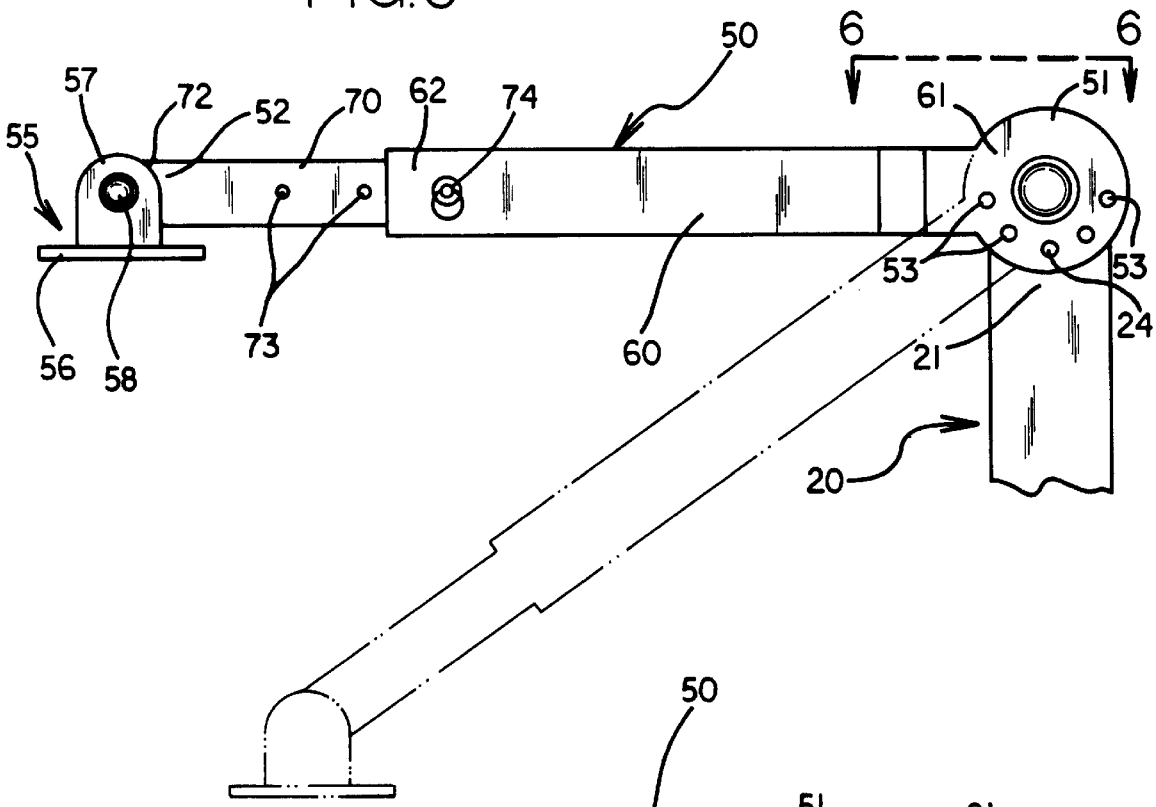
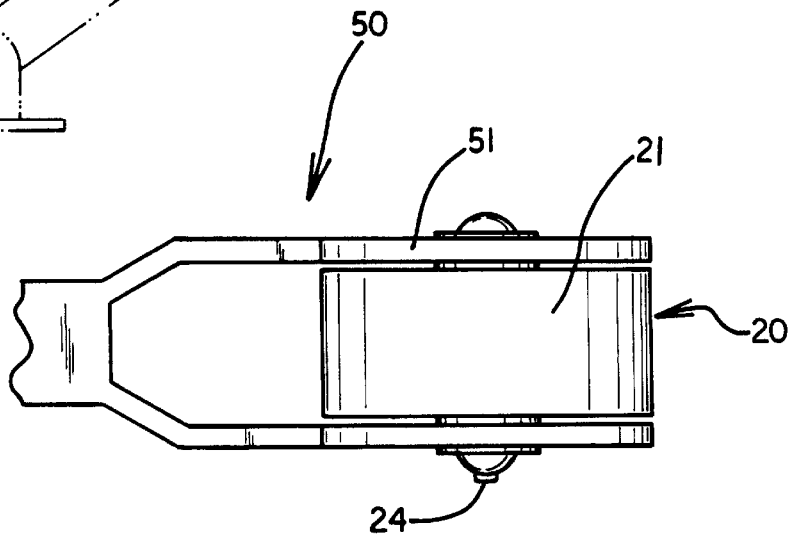
FIG. 6

SAFETY LADDER

BACKGROUND OF THE INVENTION

1. Field of the Invention

The present invention relates to ladders and more particularly pertains to a new Safety Ladder for providing a ladder which may be safely and stably positioned relative to a building.

2. Description of the Prior Art

The use of ladders is known in the prior art. More specifically, ladders heretofore devised and utilized are known to consist basically of familiar, expected and obvious structural configurations, notwithstanding the myriad of designs encompassed by the crowded prior art which have been developed for the fulfillment of countless objectives and requirements.

Known prior art ladders include U.S. Pat. No. 5,307,900; U.S. Pat. No. 5,107,958; U.S. Pat. No. 5,358,071; U.S. Pat. No. 5,215,163; U.S. Pat. No. 5,054,579; and U.S. Pat. No. D309,026.

While these devices fulfill their respective, particular objectives and requirements, the aforementioned patents do not disclose a new Safety Ladder. The inventive device includes a pair of side rails, a plurality of spaced rungs supported between the side rails, a pair of adjustable legs each telescopically extendable from a lower end of one of the side rails, and a pair of standoff arms each pivotally coupled to an upper end of one of the side rails. A first foot adapted for frictional engagement with an underlying surface is pivotally coupled to the free end of each of the adjustable legs and a second foot adapted for frictional engagement with a roof of a building is pivotally coupled to the free end of each of the standoff arms.

In these respects, the Safety Ladder according to the present invention substantially departs from the conventional concepts and designs of the prior art, and in so doing provides an apparatus primarily developed for the purpose of providing a ladder which may be safely and stably positioned relative to a building.

SUMMARY OF THE INVENTION

In view of the foregoing disadvantages inherent in the known types of ladders now present in the prior art, the present invention provides a new Safety Ladder construction wherein the same can be utilized for providing a ladder which may be safely and stably positioned relative to a building.

The general purpose of the present invention, which will be described subsequently in greater detail, is to provide a new Safety Ladder apparatus and method which has many of the advantages of the ladders mentioned heretofore and many novel features that result in a new Safety Ladder which is not anticipated, rendered obvious, suggested, or even implied by any of the prior art ladders, either alone or in any combination thereof.

To attain this, the present invention generally comprises a pair of side rails, a plurality of spaced rungs supported between the side rails, a pair of adjustable legs each telescopically extendable from a lower end of one of the side rails, and a pair of standoff arms each pivotally coupled to an upper end of one of the side rails. A first foot adapted for frictional engagement with an underlying surface is pivotally coupled to the free end of each of the adjustable legs and a second foot adapted for frictional engagement with a roof of a building is pivotally coupled to the free end of each of the standoff arms.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Safety Ladder apparatus and method which has many of the advantages of the ladders mentioned heretofore and many novel features that result in a new Safety Ladder which is not anticipated, rendered obvious, suggested, or even implied by any of the prior art ladders, either alone or in any combination thereof.

It is another object of the present invention to provide a new Safety Ladder which may be easily and efficiently manufactured and marketed.

It is a further object of the present invention to provide a new Safety Ladder which is of a durable and reliable construction.

An even further object of the present invention is to provide a new Safety Ladder which is susceptible of a low cost of manufacture with regard to both materials and labor, and which accordingly is then susceptible of low prices of sale to the consuming public, thereby making such Safety Ladder economically available to the buying public.

Still yet another object of the present invention is to provide a new Safety Ladder which provides in the apparatuses and methods of the prior art some of the advantages thereof, while simultaneously overcoming some of the disadvantages normally associated therewith.

Still another object of the present invention is to provide a new Safety Ladder for providing a ladder which may be safely and stably positioned relative to a building.

Yet another object of the present invention is to provide a new Safety Ladder which includes a pair of side rails, a plurality of spaced rungs supported between the side rails, a pair of adjustable legs each telescopically extendable from a lower end of one of the side rails, and a pair of standoff arms each pivotally coupled to an upper end of one of the side rails. A first foot adapted for frictional engagement with an underlying surface is pivotally coupled to the free end of each of the adjustable legs and a second foot adapted for frictional engagement with a roof of a building is pivotally coupled to the free end of each of the standoff arms.

Still yet another object of the present invention is to provide a new Safety Ladder that can be used on sloped or uneven terrain.

Even still another object of the present invention is to provide a new Safety Ladder that can be used on roofs of varying slope.

Even still another object of the present invention is to provide a new Safety Ladder that prevents damage to gutters or eaves by putting the weight of the ladder and the user on the roof instead of the gutters or eaves.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a side elevation view of one of the standoff arms of the present invention.

FIG. 6 is a top elevation view of one of the standoff arms from the perspective of line 6—6 of FIG. 5.

DESCRIPTION OF THE PREFERRED EMBODIMENT

Figure 1:
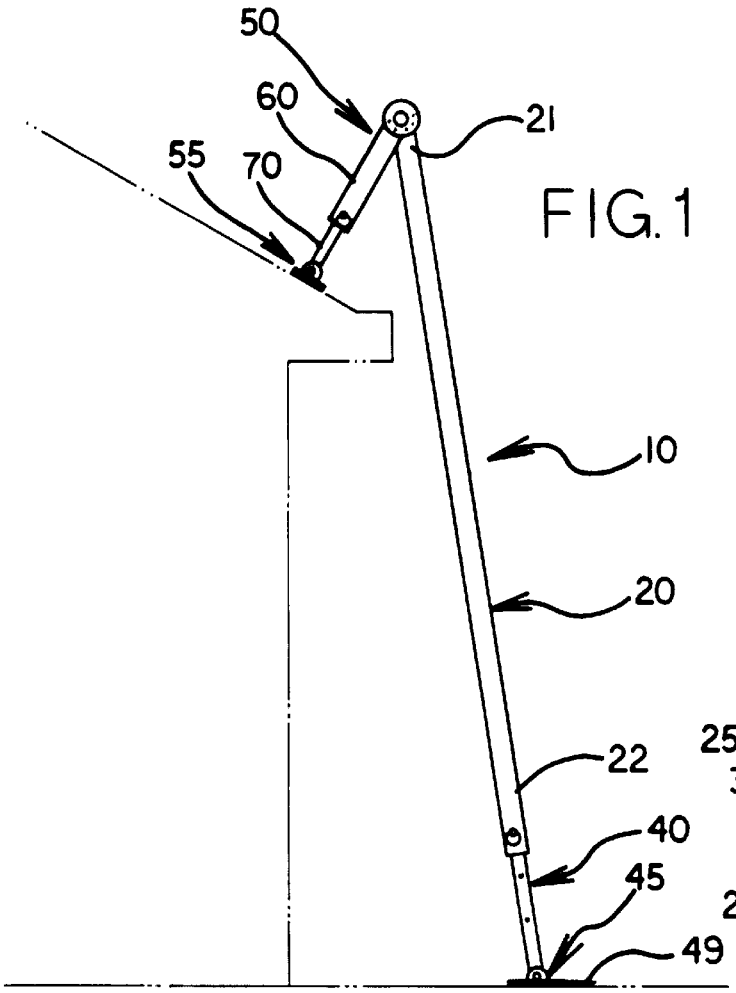
FIG. 1 is a side elevation view of a new Safety Ladder according to the present invention.

With reference now to the drawings, and in particular to FIGS. 1 through 6 thereof, a new Safety Ladder embodying the principles and concepts of the present invention and generally designated by the reference numeral 10 will be described.

As best illustrated in FIGS. 1 through 6, the Safety Ladder 10 comprises a pair of side rails 20, a plurality of spaced rungs 30 supported between the side rails 20, a pair of adjustable legs 40 each telescopically extendable from a lower end 22 of one of the side rails 20, and a pair of standoff arms 50 each pivotally coupled to an upper end 21 of one of the side rails 20. A first foot 45 adapted for frictional engagement with an underlying surface is pivotally coupled to the free end of each of the adjustable legs 40 and a second foot 55 adapted for frictional engagement with a roof of a building is pivotally coupled to the free end of each of the standoff arms 50.

Figure 2:
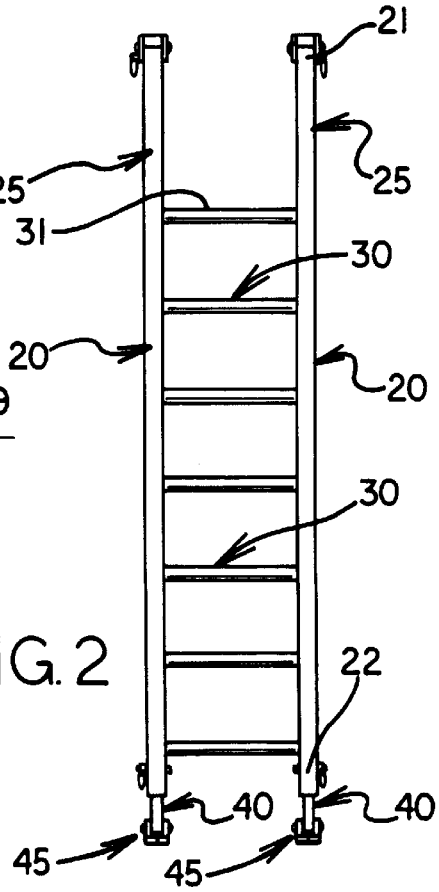
FIG. 2 is a front elevation view thereof.
Figure 3:
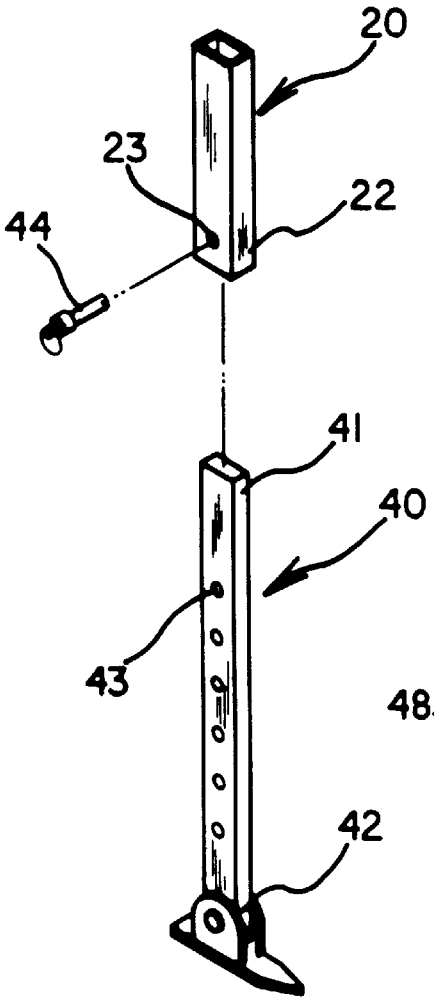
FIG. 3 is an exploded isometric illustration of the adjustable legs of the present invention.
Figure 3:
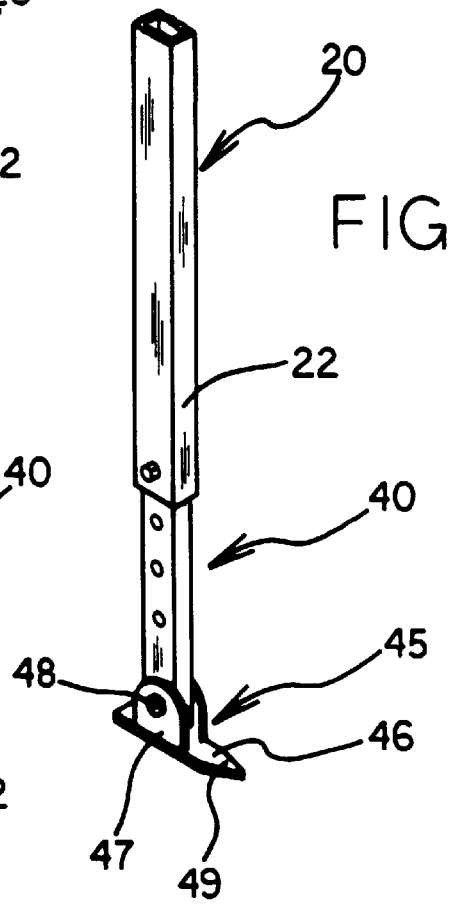

As best illustrated in FIGS. 1 and 2, each of the side rails 20 have an upper end 21 and a lower end 22 wherein the lower ends 22 of each of the side rails 20 are open. In addition, each of the side rails 20 have a side-rail hole 23 perpendicularly therethrough adjacent the lower ends 22 thereof. The upper ends 21 of each of the side rails 20 extend substantially beyond a top rung 31 of the plurality of rungs 30 so as to form a pair of hand rails 25 when the Safety Ladder 10 is positioned in a normal upwardly extending position. The hand rails 25 aid a user while getting off the Safety Ladder 10 and onto the roof of the building and while getting off the roof and onto the Safety Ladder 10. The hand rails 25 are of a length such that when the user steps between the hand rails 25 the upper ends 21 of the side rails 20 extend generally above the knees of the user and, preferably, to the waist thereof.

The plurality of spaced rungs 30 extend perpendicularly between the pair of side rails 20. Accordingly, the plurality of spaced rungs 30 are each secured to the side rails 20 in a spaced-apart parallel relationship.

As best illustrated in FIGS. 1 through 4, each of the adjustable legs 40 have a first end 41 and a second end 42. In addition, each of the adjustable legs 40 have a plurality of aligned leg holes 43 perpendicularly therethrough. The plurality of aligned leg holes 43 are provided in spaced relation intermediate the first end 41 and the second end 42 of each of the adjustable legs 40. The first end 41 of each of the adjustable legs 40 are telescopically positioned within the lower end 22 of one of the side rails 20. Accordingly, each of the adjustable legs 40 are independently extendable from the lower end 22 of one of the side rails 20 so as to compensate for an uneven or sloping underlying surface.

Each of the adjustable legs 40 are retained in a desired position by a first retention pin 44. As such, the first retention pin 44 is selectively inserted through the side-rail hole 23 provided in one of the side rails 20 and through one of the plurality of aligned leg holes 43 provided in one of the adjustable legs 40.

A first foot 45 is pivotally coupled to the second end 42 of each of the adjustable legs 40. The first foot 45 includes a base 46 and a pair of spaced flanges 47 protruding upward from the base 46. Accordingly, the first foot 45 is pivotally coupled to each of the adjustable legs 40 by a first pivot pin 48 extending through the pair of spaced flanges 47 and the second end 42 of each of the adjustable legs 40.

Figure 4:
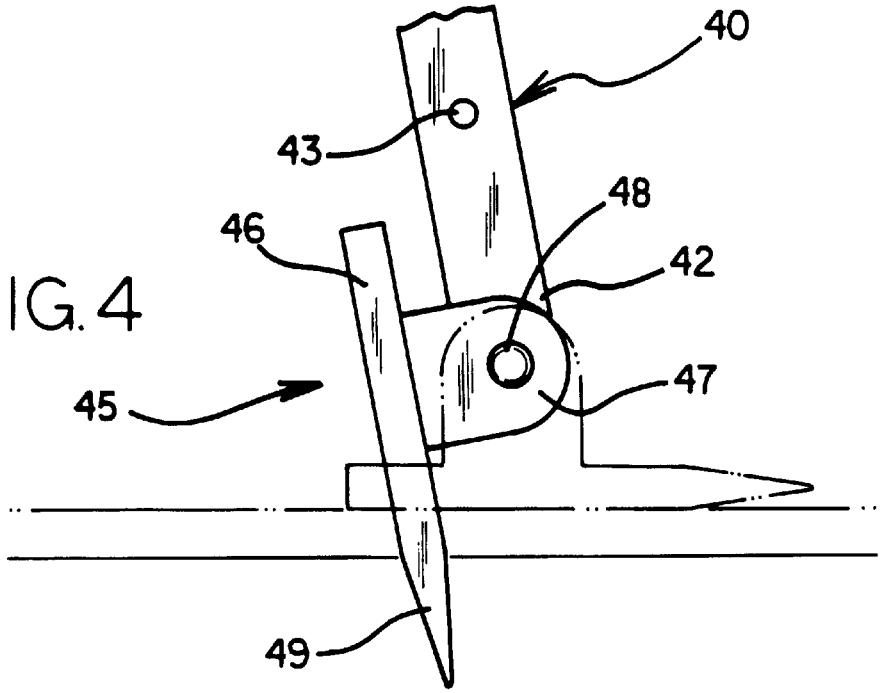
FIG. 4 is a side elevation view of the foot provided at the end of one of the adjustable legs of the present invention.

In a preferred embodiment, an elongated spike 49 protrudes from the first foot 45. The elongated spike 49 is oriented parallel to and protrudes outward from one end of the base 46 of the first foot 45. As such, the first foot 45 is pivotable between a first position wherein the base 46 of the first foot 45 rests on the underlying surface and a second position wherein the elongated spike 49 is driven into the underlying surface (FIG. 4).

As best illustrated in FIGS. 5 and 6, each of the standoff arms 50 have a first end 51 and a second end 52. The first end 51 of each of the standoff arms 50 are pivotally coupled to an upper end 21 of one of the side rails 20 wherein the standoff arms 50 may be oriented at various angles relative to the side rails 20. Accordingly, the second end 52 of each of the standoff arms 50 rest on the roof of the building whereby the standoff arms 50 support the side rails 20 away from the building.

In an illustrative embodiment, each of the standoff arms 50 have a plurality of spaced holes 53 therethrough adjacent the first end 51 thereof. The plurality of spaced holes 53 are arranged in a generally semi-circular pattern. In addition, a depressible pin 24 perpendicularly projects from each of the side rails 20 adjacent the upper end 21 thereof wherein the depressible pin 24 selectively projects through one of the spaced holes 53 provided in one of the standoff arms 50. Accordingly, to adjust the orientation of the standoff arm 50 relative to the side rail 20, the depressible pin 24 is depressed and the standoff arm 50 pivoted such that the depressible pin 24 projects through another one of the spaced holes 53 provided therein.

A second foot 55 is pivotally coupled to the second end 52 of each of the standoff arms 50. The second foot 55 includes a base 56 and a pair of spaced flanges 57 protruding upward from the base 56. Accordingly, the second foot 55 is pivotally coupled to each of the standoff arms 50 by a second pivot pin 58 extending through the pair of spaced flanges 57 and the second end 52 of each of the standoff arms 50.

In a preferred embodiment, each of the standoff arms 50 are adjustable. Accordingly, each of the standoff arms 50 comprise a fixed arm 60 pivotally coupled to the upper end 21 of one of the side rails 20 and an extension arm 70 extendable from the fixed arm 60. The fixed arm 60 and the extension arm 70 each have an innermost end, and an outermost end 62 and 72, respectively, wherein the outermost end 62 of the fixed arm 60 is open. As such, the innermost end of the extension arm 70 is telescopically positioned within the outermost end 62 of the fixed arm 60. Accordingly, the extension arm 70 is extendable from the outermost end 62 of the fixed arm 60 so as to offset the side rails 20 from the building.

The extension arm 70 is retained in a desired position by a second retention pin 74. Accordingly, the fixed arm 60 has a fixed-arm hole perpendicularly therethrough adjacent the outermost end 62 thereof. In addition, the extension arm 70 has a plurality of aligned arm holes 73 perpendicularly therethrough. The plurality of aligned arm holes 73 are provided in spaced relation intermediate the innermost end and the outermost end 72 of the extension arm 70. As such, the second retention pin 74 is selectively inserted through the fixed-arm hole provided in the fixed arm 60 and through one of the plurality of aligned arm holes 73 provided in the extension arm 70.

In use, the Safety Ladder 10 is positioned in a normal upwardly extending position with the side rails 20 being oriented generally upright. As such, the adjustable legs 40 are independently adjusted to compensate for an uneven or sloping underlying surface. In addition, the standoff arms 50 are oriented and adjusted for abutting the roof of the building and supporting the side rails 20 away from the building. The first foot 45 provided at the second end 42 of each of the adjustable legs 40 is oriented in the first position when the underlying surface is a hard surface and oriented in the second position when the underlying surface is an earthen surface wherein the elongated spike 49 is driven into the earthen surface.

Accordingly, the user of the Safety Ladder 10 may climb upon the plurality of spaced rungs 30 to the roof of the building. Upon reaching the top rung 31, the user may step between and use the pair of hand rails 25 formed by the upper ends 21 of each of the side rails 20 while getting off the Safety Ladder 10 and onto the roof of the building. Conversely, the user may step between and use the pair of hand rails 25 while getting off the roof and onto the Safety Ladder 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A safety ladder, comprising:

a pair of side rails each having an upper end and a lower end, said lower end of each of said pair of side rails being open;

a plurality of spaced rungs supported between said pair of side rails, said upper end of each of said pair of side rails extending substantially beyond a top rung of said plurality of spaced rungs thereby forming a pair of hand rails, said pair of hand rails being of a length such that when a user steps between said pair of hand rails said upper end of each of said pair of side rails extends generally above the knees of said user;

a pair of adjustable legs each extendable from said lower end of one of said pair of side rails, each of said pair of adjustable legs having a first end and a second end, said first end of each of said pair of adjustable legs telescopically positioned within said lower end of one of said pair of side rails;

a first foot pivotally coupled to said second end of each of said pair of adjustable legs, said first foot adapted for frictional engagement with an underlying surface, said first foot including a base and an elongated spike oriented generally parallel to and protruding from one end of said base, said first foot pivotable between a first position wherein said elongated spike is generally horizontally oriented when said base is in a position to rest on said underlying surface and a second position wherein said elongated spike is generally vertically oriented to be driven into said underlying surface;

wherein lateral sides of said spike taper together towards a front end of said spike, and wherein upper and lower sides of said spike taper together towards said front end of said spike;

said spike having a length defined between said front end thereof and said first foot, each of said side rails having a width defined between front and back edges thereof taken generally perpendicularly said rungs, wherein said length of said spike is greater than said width of said side rails;

a pair of standoff arms each pivotally coupled to one of said pair of side rails, each of said pair of standoff arms having a first end and a second end, said first end of each of said pair of standoff arms pivotally coupled to said upper end of one of said pair of side rails wherein each of said pair of standoff arms are variably oriented relative to one of said pair of side rails;

a second foot pivotally coupled to said second end of each of said pair of standoff arms, said second foot adapted for frictional engagement with a roof of a building, said pair of standoff arms for supporting said pair of side rails away from said building; and a first retention means for retaining each of said pair of standoff arms in a desired orientation relative to one of said pair of side rails;

wherein each of said pair of standoff arms have a plurality of spaced holes therethrough adjacent said first end thereof, and wherein said first retention means comprises a depressible pin perpendicularly projecting from each of said pair of side rails adjacent said upper end thereof, said depressible pin selectively projected through one of said plurality of spaced holes provided in one of said pair of standoff arms.

2. The safety ladder of claim 1, wherein said length of said spike is at least 1 and ¼ times greater than said width of each of said side rails.

3. The safety ladder of claim 1, further comprising:

a second retention means for retaining each of said pair of adjustable legs in a desired position relative to one of said pair of side rails.

4. The safety ladder of claim 3, wherein each of said pair of side rails have a side-rail hole perpendicularly therethrough adjacent said lower end thereof, wherein each of said pair of adjustable legs have a plurality of aligned leg holes perpendicularly therethrough, and wherein said second retention means comprises:

a first retention pin selectively inserted through said side-rail hole provided in one of said pair of side rails and through one of said plurality of aligned leg holes provided in one of said pair of adjustable legs.

5. The safety ladder of claim 1, wherein each of said pair of standoff arms are extendable.

6. The safety ladder of claim 1, wherein each of said pair of standoff arms comprise:

a fixed arm pivotally coupled to one of said pair of side rails, said fixed arm having an innermost end and an outermost end, said innermost end of said fixed arm pivotally coupled to said upper end of one of said pair of side rails, said outermost end of said fixed arm being open, and an extension arm extendable from said fixed arm, said extension arm having an innermost end and an outermost end, said innermost end of said extension arm telescopically positioned within said outermost end of said fixed arm.

7. The safety ladder of claim 6, further comprising:

a third retention means for retaining said extension arm in a desired position relative to said fixed arm.

8. The safety ladder of claim 7, wherein said fixed arm has a fixed-arm hole perpendicularly therethrough adjacent said outermost end thereof, wherein said extension arm has a plurality of aligned arm holes perpendicularly therethrough, and wherein said third retention means comprises:

a second retention pin selectively inserted through said fixed-arm hole provided in said fixed arm and through one of said plurality of aligned arm holes provided in said extension arm.

9. The safety ladder of claim 1, wherein each of said pair of standoff arms comprise a fixed arm pivotally coupled to one of said pair of side rails, and an extension arm extendable from said fixed arm, and further comprising:

a third retention means for retaining said extension arm in a desired position relative to said fixed arm.

* * * * *